US006000641A

United States Patent [19]

Komoriya et al.

[11] Patent Number: 6,000,641

[45] Date of Patent: Dec. 14, 1999

[54] METHOD OF CRUSHING AND MIXING SOIL AND MACHINE THEREFOR

[75] Inventors: Yoichi Komoriya, Tokyo; Yasuhiro Yoshida; Taneaki Fujino, both of Kawasaki, all of Japan

[73] Assignee: Komatsu Ltd., Tokyo, Japan

[21] Appl. No.: 09/101,643

[22] PCT Filed: Jan. 9, 1997

[86] PCT No.: PCT/JP97/00022

§ 371 Date: Jul. 13, 1998

§ 102(e) Date: Jul. 13, 1998

[87] PCT Pub. No.: WO97/25486

PCT Pub. Date: Jul. 17, 1997

[30] Foreign Application Priority Data

Jan. 12, 1996 [JP] Japan ..... 8-022054

[51] Int. Cl.[6] ..... B02C 19/12

[52] U.S. Cl. ..... 241/29; 241/101.74; 241/152.2

[58] Field of Search ..... 241/287, 288, 241/289, 290, 3, 152.2, 27, 29, 194, 195, 285.3, 101.74, 101.741, 101.742

[56] References Cited

U.S. PATENT DOCUMENTS 5,205,496 4/1993 O'Donnell et al. ..... 241/152.2

5,240,188 8/1993 Whitmire ..... 241/152.2

FOREIGN PATENT DOCUMENTS 54-58901 5/1979 Japan .

58-76657 5/1983 Japan .

61-124505 6/1986 Japan .

1-147050 10/1989 Japan .

4-9586 2/1992 Japan .

6-52928 7/1994 Japan .

6-277538 10/1994 Japan .

7-124457 5/1995 Japan .

*Primary Examiner*—Mark Rosenbaum

*Attorney, Agent, or Firm*—Sidley & Austin

[57] ABSTRACT

The invention relates to a method and device for crushing and mixing soil and a soil improving agent in order to regenerate soft or sticky soil. According to the method of the invention, the soil and the soil improving agent are cut, crushed, and mixed by a crusher (7) in a primary cutting, crushing, and mixing process, and are then struck, crushed, and mixed in a secondary cutting, crushing, and mixing process. The device of the invention comprises the crusher (7), a rotary cutter (13) at the upper part of the crusher (7), a striker (10B) at the lower part thereof, and a conveyor (8) arranged on a vehicle body (3).

11 Claims, 4 Drawing Sheets

METHOD OF CRUSHING AND MIXING SOIL AND MACHINE THEREFOR

FIELD OF THE INVENTION

The present invention relates to a method of crushing and mixing soil in order to improve soil of soft ground, at the time of land reclaiming works or general engineering works, and sticky soil dug during water supply works, drainage works, or gas pipe laying works, etc., and a machine for executing this method.

BACKGROUND OF THE INVENTION

At present, it is inevitable that civil engineering work, construction work, etc., are required to be performed on soft ground, such as reclaimed land, in order to promote efficient use of limited space. Such soft ground is usually dehydrated by scattering a hardening agent so that the soil is regenerated. Further, when water supply or drainage works or gas pipe laying works are carried out, the ditches for laying the pipes are usually refilled, using soil which has been dug by construction machines such as hydraulic shovels.

However, watery clay or sticky soil, which has been dug and stirred up by hydraulic shovels or the like, cannot hold itself. Therefore, soil which is not usable for filling the ditches has to be relocated using dump tracks.

Japanese Patent Laid-Open Publication 54-58901 has proposed a soil improving method in order to overcome these problems. According to the publication, a predetermined amount of sticky soil, which is not applicable to filling ditches, is sequentially supplied, contacted with a soil improving agent having wet-hard characteristics in a predetermined ratio, and then crushed and mixed. The publication also discloses a soil improving machine, which comprises a conveyor for relocating sticky soil which is not usable for filling ditches, a cut screw for slicing the unusable soil into layers having a predetermined thickness and for removing surplus soil at an appropriate position, a device for adding a predetermined amount of wet-hard type soil improving agent to a preset amount of soil carried on a conveyor, and a crusher for crushing and mixing the soil and the soil improving agent.

The foregoing soil improving machine, however, crushes and mixes soil and soil improving agent using only one crushing cutter; thus it is difficult to efficiently mix the soil with the soil improving agent.

An impact crushing/mixing machine for dug soil is known in Japanese Patent Publication 4-9586. This machine includes rotary strikers, flexible crushing plates, and a casing which houses a plurality of crushing pieces coupled to the flexible crushing plates, at least a pair of elastic members extending along the flexible crushing plates, and a support for coupling flexible crushing plates in the vicinity of the elastic members.

However, such an impact crushing/mixing machine has a problem in that it cannot crush and mix sticky soil but only deform it.

There is another problem in that a lot of dust is generated when soft ground is dried by hardening agent. There is a further problem in that when a construction site is narrow, construction machines, such as vehicles for scattering hardening agent and vibrating rollers for ramming the land, etc., cannot be simultaneously introduced there. Still further, construction cost is increased when a number of construction machines are used according to conventional methods.

SUMMARY OF THE INVENTION

The present invention has been conceived in order to overcome the foregoing problems of the related art, and is intended to provide a method and a device for efficiently crushing and mixing soil improving agent with watery clay, sticky soil, or soil containing pebbles, without clogging.

According to the invention, there is provided a method using a crusher for crushing and mixing soil and soil improving agent carried on a conveyor. The method comprises a primary cutting, crushing and mixing process in which the soil and the soil improving agent are cut, crushed, and mixed by the crusher; and a secondary striking, crushing, and mixing process in which the soil and the soil improving agent are struck, crushed, and mixed. It is preferable that the primary cutting, crushing, and mixing process is executed by a rotary cutter provided in the crusher, and that the secondary striking, crushing, and mixing process is executed by the rotary strikers of the crusher.

In the primary cutting, crushing, and mixing process, the soil or the clod can be cut to a thickness depending upon a speed of the conveyor, and crushed and mixed with the soil improving agent. Further, the slower the conveyor, the more extensively the soil or the clod can be crushed, pounded, and mixed with the soil improving agent. Thereafter, the mixed soil and soil improving agent are further struck, crushed, and mixed in the secondary striking, crushing, and mixing process, thereby enabling uniform mixing of the soil and the soil improving agent. Therefore, soft ground, such as reclaimed land, is efficiently crushed and mixed with a soil improving agent, such as lime, so that watery clay or sticky soil can be regenerated as land with usable soil.

The invention also provides a first soil crushing and mixing device, installed on a vehicle body and comprising hoppers, for receiving the soil and the soil improving agent, and a crusher for crushing and mixing the soil and the soil improving agent. The crusher includes a rotary cutter in an upper part thereof and at least one rotary striker in a lower part thereof. The intake conveyor is arranged on the vehicle body in order to carry the soil and the soil improving agent to the crusher.

The crusher can include a plurality of rotary strikers. One of the rotary strikers is attached to a rear frame of the crusher. The rear frame can be moved upwardly and downwardly. Alternatively, the crusher can include a plurality of rotary strikers which can be positioned obliquely downwardly in an advancing direction of the soil and the soil improving agent. The strikers have detachable blades. Each blade is constituted by a plurality of hard plates and soft plates which are alternately arranged. The hard plates extend high while the soft plates extend low such that both of these plates form an uneven top surface. The rotary cutter is preferably attached so as to be moved upwardly and downwardly, and can be arranged in an opening of the crusher. The opening faces a discharging side of the conveyor.

In the foregoing arrangement, the soil and the soil improving agent are cut, crushed and mixed by the rotary cutter of the crusher. Thereafter, the mixed soil and soil improving agent are efficiently struck, crushed, and mixed by the rotary strikers. One of the strikers can be provided in the rear frame which is movable upwardly and downwardly. When the rear frame is moved upwardly to open the crusher, the interior of the crusher can be inspected by eye and easily maintained. This facilitates inspection and maintenance work. When a plurality of rotary strikers are provided, the soil and the soil improving agent are sequentially struck several times, thereby being efficiently crushed and mixed.

The rotary strikers have detachable blades in order to facilitate replacement of worn blades. The blades include plates, which have different rigidities and take different time periods to wear, alternately arranged, so that they enable the blades to maintain their uneven top surfaces. The same holds true when hard plates with the same thickness but with different lengths are alternately arranged. The rotary cutter is vertically movable, and usually cuts, crushes, and mixes soil and soil improving agent at a lowest position because of its own weight. Conversely, when soil containing pebbles or the like is delivered, the rotary cutter is pushed upwardly, thereby dropping soil. Then, such soil is struck, cut, and mixed by the rotary strikers, and does not clog in the vicinity of the rotary cutter. The rotary cutter, arranged near the discharge side of the conveyor, is effective in cutting, crushing, and mixing the soil and the soil improving agent.

In a second soil crushing and mixing device, the crusher crushes and mixes the soil and the soil improving agent, and includes a rotary cutter, disposed at an upper part thereof, at least one rotary striker, disposed at a lower part thereof, and a vibrating plate, housed therein.

The second soil crushing and mixing device can efficiently crush and mix the soil and the soil improving agent similarly to the first soil crushing and mixing device. The presence of the vibrating plate is effective in preventing the soil and the soil improving agent from sticking onto the inner wall of the crusher.

BRIEF DESCRIPTION OF THE DRAWINGS

FIG. 5A specifically shows a crusher having a detachable rear frame; and FIG. 5B specifically shows a crusher whose rear frame can be opened or closed.

BEST MODE TO CARRY OUT THE INVENTION

The invention will be described with reference to a preferred embodiment shown in the accompanying drawings.

Figure 1:
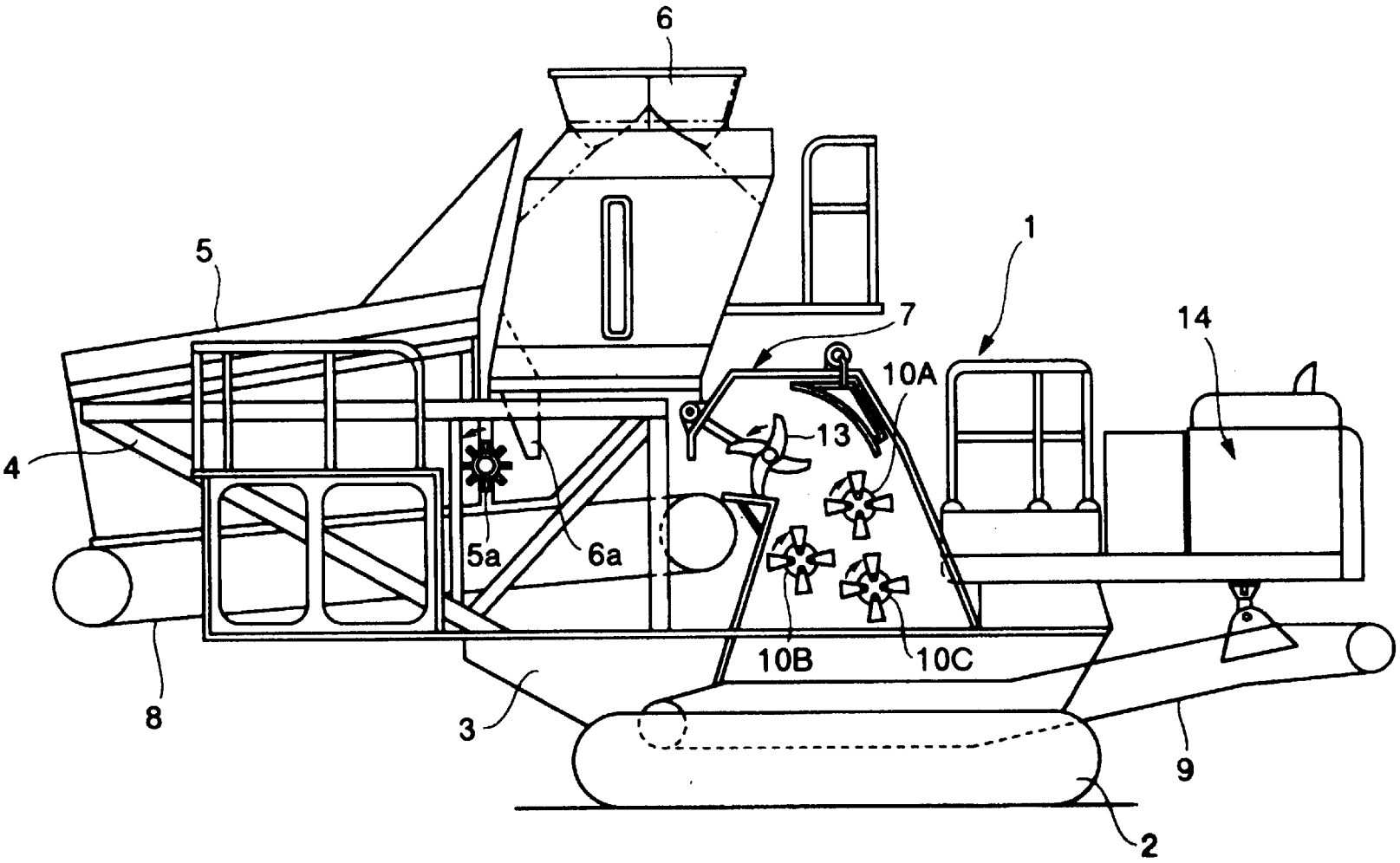
FIG. 1 is a side view of a crawler type soil improving machine related to the present invention.

FIG. 1 shows a crawler type soil improving machine 1 to which a crushing and mixing device (called "crusher" hereinafter) according to the invention is applied. The crawler type soil improving machine 1 includes: a crawling member 2, which is at the lower part of the machine, which is driven by a motor (not shown), and which is movable as desired; a vehicle body 3, which is arranged on the crawling member 2; a support frame 4, which is integral with the front end of the vehicle body 3; first and second hoppers 5 and 6, which are arranged is on and fixed to the support frame 4; and an intake conveyor 8, which is positioned below the first and second hoppers 5 and 6, and which is attached to the vehicle body 3.

Further, the crawling type soil improving machine 1 includes a crusher 7, which is at a discharge side of the intake conveyor 8 and is disposed on the vehicle body 3; and a discharge conveyor 9, for carrying the crushed soil and soil improving agent to outside. An auxiliary soil discharge unit 5*a* is at a lower rear part of the first hopper 5 and is provided on the vehicle body 3. The second hopper 6 has an outlet 6*a* at its lower part in order to discharge the soil improving agent, such as lime, which is usually used. A machine cabin 14 is positioned at the rear part of the vehicle body 3 in order to house an engine, hydraulic units, etc.

Figure 2A:
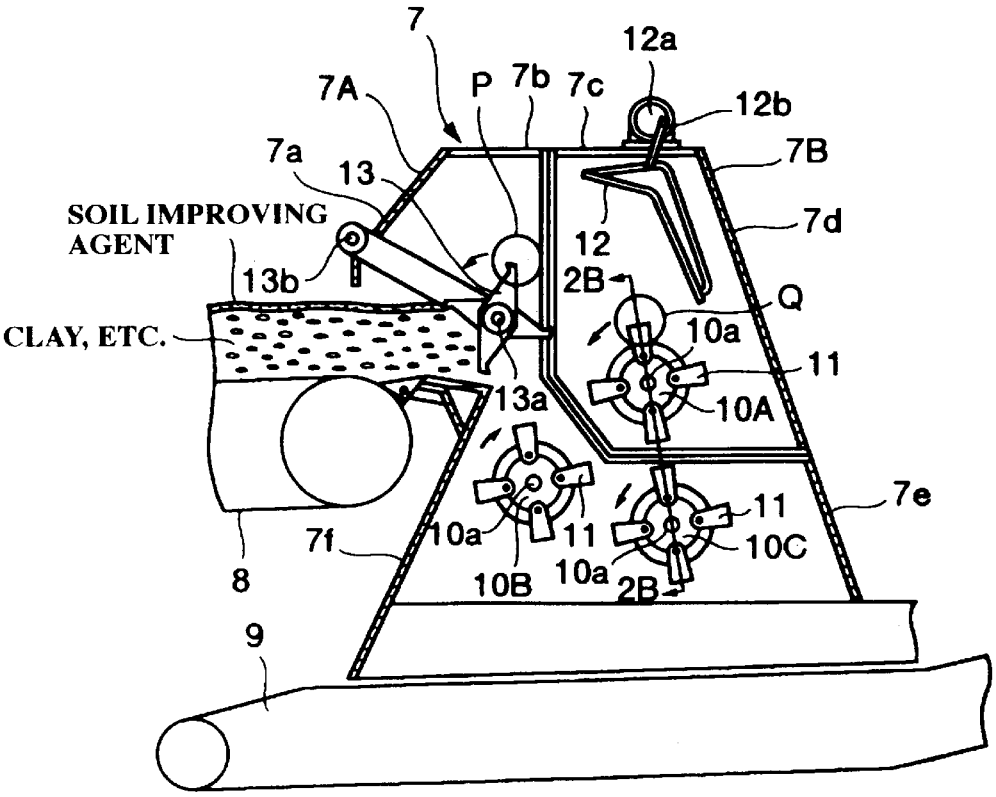
FIG. 2A is a cross section showing details of the crusher of the machine in FIG. 1.
Figure 2B:
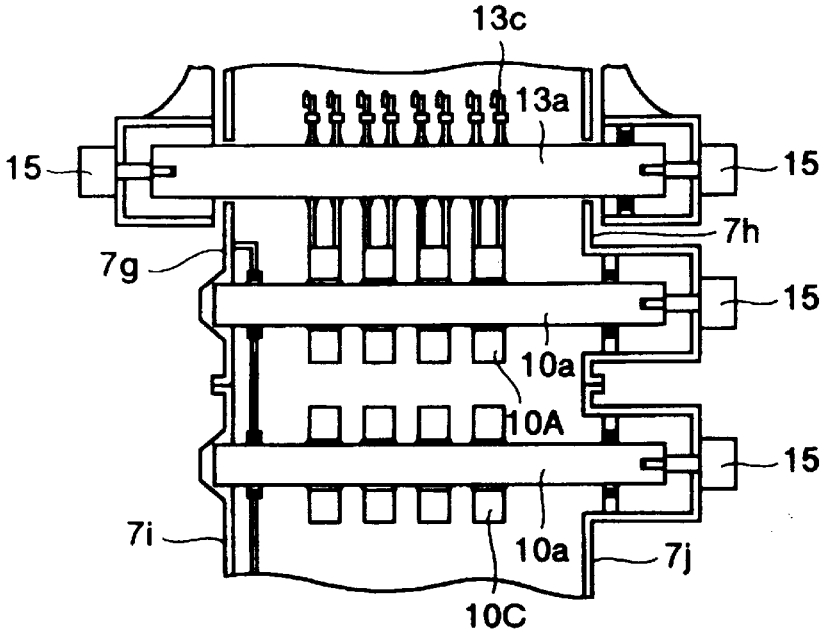
FIG. 2B is a cross section taken along line 2B—2B in FIG. 2A.
Figure 3:
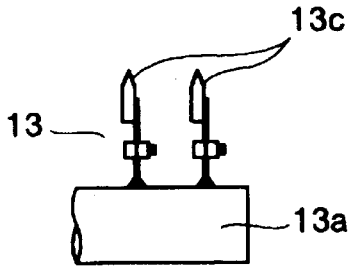
FIG. 3 is a detailed view of the part P in FIG. 2A, showing a rotary cutter.
Figure 5A:
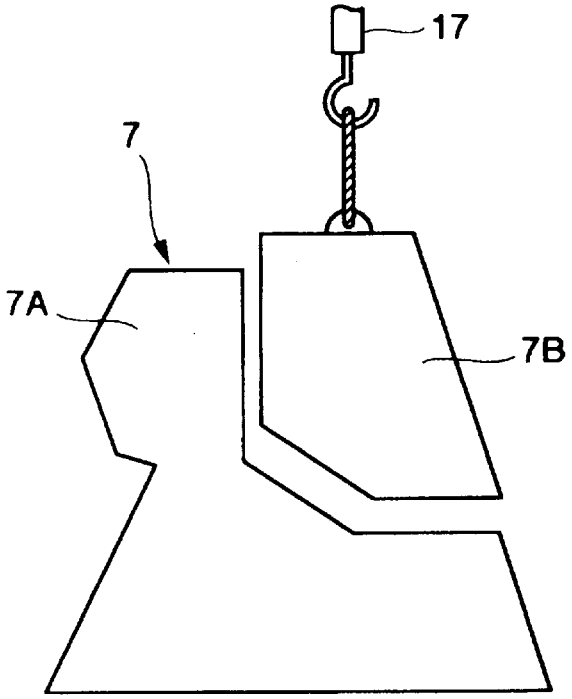
FIG. 5A and FIG. 5B show how the crusher in FIG. 2A is opened for inspection and maintenance.
Figure 5B:
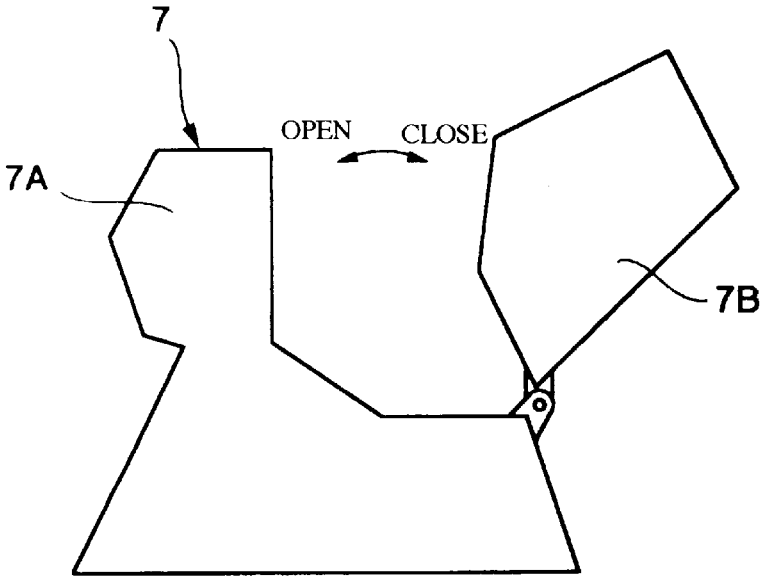

Referring to FIGS. 5A and 5B, the crusher 7 is constituted by a front frame 7A and a rear frame 7B. As shown in FIGS. 2A and 2B, the front and rear frames 7A and 7B are in the shape of a box, and include an upper front plate 7*a*, a lower front plate 7*f*, top plates 7*b* and 7*c*, an upper rear plate 7*d*, a lower rear plate 7*e*, a front right side plate 7*h*, a rear right side plate 7*j*, a front left side plate 7*g*, and a rear left side plate 7*i*. The front and rear frames 7A and 7B are separable. An opening is formed between the upper and lower front plates 7*a* and 7*f*, so that the soil and the soil improving agent are delivered into the crusher 7 through the opening by the intake conveyor 8.

As shown in FIG. 2A, a support 13*b* is fixed to the upper front plate 7*a* in order to support a rotary cutter 13. The rotary cutter 13 moves downwardly by its own weight, and is raised by force applied from an underside, i.e., can be moved upwardly and downwardly. The rotary cutter 13 has a plurality of blades 13*c*, each of which is attached to a drive shaft 13*a*, which is driven by a pair of motors 15 shown in FIG. 2B.

A plurality of rotary strikers 10A, 10B and 10C are arranged obliquely downwardly of the rotary cutter 13 shown in FIG. 2A. Specifically, the rotary striker 10B is positioned obliquely downwardly of the rotary striker 10A, while the striker 10C is positioned obliquely downwardly of the rotary striker 10B. The rotary strikers 10B and 10C are housed in the front frame 7A while the rotary striker 10A is in the rear frame 7B. The three rotary strikers 10A to 10C are used in this embodiment. However, the number of rotary strikers depends upon the use of the crawler type soil improving machine. Alternatively, one rotary striker (10B, for example) can be sufficient.

Referring to FIG. 2B, the rotary strikers 10A, 103 and 10C are respectively and integrally fixed to three horizontal shafts 10*a* which are supported by the side plates 7*g*, 7*h*, 7*i*, and 7*j*. The horizontal shafts 10*a* are driven by the motors 15. A drive shaft 12*a* is arranged on the upper front plate 7*c* of the crusher 7, and is driven by a motor (not shown). A vibrating plate 12 is provided in the crusher 7, and is coupled to the drive shaft 12*a* via a link 12*b*.

Figure 4A:
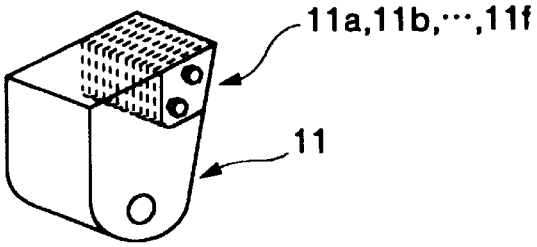
FIG. 4A is a perspective view of a rotary striker, showing details of the part Q in FIG. 2A.
Figure 4B:
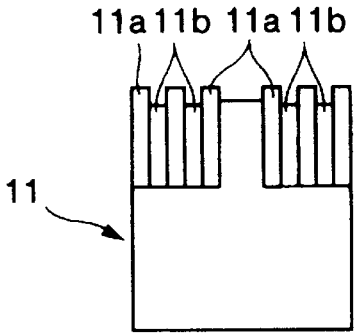
FIG. 4B to FIG. 4D show how plates are attached to a blade shown in FIG. 4A.

Each of rotary strikers 10A, 10B and 10C includes detachable blades 11, each of which has plates 11*a* and 11*b*. Materials, shapes, and quantities of the plates 11*a* and 11*b* are determined in accordance with necessity. In a first example shown in FIG. 4A, the blade 11 is provided with hard plates 11*a* and soft plates 11*b* which are alternately arranged. The hard plates 11a extend high while the soft plates 11*b* extend low, i.e. the soft plates 11*b* are sandwiched and recessed between the hard plates 11*a*. Therefore, these plates 11*a* and 11*b* form an uneven top surface.

Figure 4C:
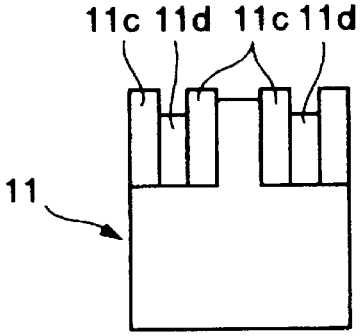
Figure 4D:
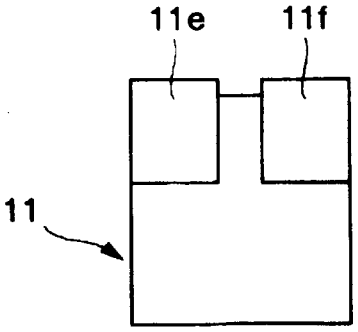

FIG. 4C shows a second example of the rotary striker. In this example, hard and soft blades 11*c* and 11*d* are thicker than the plates 11*a* and 11*b* in the first example. Similarly to the first example, the hard plates 11*c* extend high while the soft plates 11*d* extend low, and are alternately arranged, i.e. the soft plates 11*d* are sandwiched and recessed between the hard plates 11*c*. The plates 11*d* can be as hard as the plates 11*c*. A third example of the rotary striker is shown in FIG. 4D. A pair of hard plates 11*e* and 11*f* are attached to the blade 11 with a space kept therebetween.

Referring to FIG. 2A, the opening of the crusher 7 faces the discharge side of the intake conveyor 8. This enables the soil and the soil improving agent carried by the intake conveyor 9 to be smoothly delivered to the crusher 7. The soil and the soil improving agent, which have been crushed and mixed by the crusher 7, are conveyed to the outside by the discharge conveyor 9 under the crusher 7. With this crusher 7, the rear frame 7B is separated from the front frame 7A when the former is hooked up using a crane 17 as shown in FIG. 5A. Alternatively, the rear frame 7B can be detachably attached to the front frame 7A, and opened and closed using an actuator (not shown). This arrangement is effective in facilitating inspection and maintenance of the crusher 7.

The crawler type soil improving machine 1 (incorporating the crusher according to the invention) operates as follows. A sticky clod is scooped and put into the first hopper 5 by a hydraulic shovel or the like and then dropped onto the intake conveyor 8. Soil on the intake conveyor 8 has its height regulated by an auxiliary soil discharge unit 5*a* in order to have an equal height, and is carried toward the opening of the crusher 7. At the same time, a predetermined amount of the soil improving agent is delivered via an outlet 6*a* to the intake conveyor 8 in order to cover the soil whose height is uniform. The soil covered with the soil improving agent is carried to the crusher 7 via the opening thereof. The soil and the soil improving agent are subjected to the primary cutting, crashing and mixing process executed by the rotary cutter 13, which is rotating at a predetermined speed. In his process, the clods and the soil improving agent are cut, crushed, and mixed.

After the primary cutting, crushing, and mixing process, the soil and the soil improving agent undergo the secondary striking, crushing, and mixing process, i.e., the soil and the soil improving agent are caught and struck by the plurality of strikes 10A, 10B, and 10C. At this stage, the soil and the soil improving agent are struck and crushed into small lumps or small particles, which are efficiently mixed. The primary and secondary processes enable the sticky soil and the soil improving agent to be mixed uniformly and efficiently. Soil regenerated by the secondary process is discharged out of the soil improving machine 1, and can be reused.

The rotary strikers 10A, 10B, and 10C are located below the intake conveyor 8, which is carrying soil and soil improving agent, i.e., they are positioned obliquely downwardly of the rotary cutter 13 so that the soil and the soil improving agent can be reliably struck, and easily crushed and mixed. When the crusher 7 includes the vibrating plate 12, the plate 12 is vertically vibrated by the drive shaft 12 a in order to effectively prevent soil and soil improving agent from sticking on an inner wall of the crusher 7.

The blades 11 are detachable from the rotary strikers 10A, 10B, and 10C. Therefore, a worn blade 11 can be easily replaced. Further, since the hard and soft plates 11*a* and 11*b* are alternately arranged, the outer peripheral surface of the blades can remain uneven even when the strikers are used for a long time. The hard and soft blades 11*a* and 11*b* take different time periods to wear out. Therefore, soil and soil improving agent can be well crushed and mixed. The hard plates 11*c* and 11*d* with the same thickness but with different heights take different time periods to wear out, and can maintain the uneven top surface similarly to the foregoing plates. Therefore, the blades 11 have long life and are durable.

INDUSTRIAL APPLICABILITY

The invention provides the method and device which allow efficient crushing and mixing of soft ground soil and a soil improving agent in order to regenerate such soil. The method and device can improve efficiency of crushing and mixing operations at a reduced cost.

What is claimed is:

1. Apparatus comprising:

a vehicle body;

a soil improving and mixing device installed on said vehicle body, said soil improving and mixing device comprising:

a hopper for receiving soil;

a hopper for receiving a soil improving agent;

a conveyer for carrying soil and soil improving agent supplied from said hoppers; and a crusher for crushing and mixing soil and soil improvement agent carried by said conveyor;

wherein said crusher includes a vertically movable rotary cutter in an upper part thereof, and at least one rotary striker in a lower part thereof.

2. Apparatus in accordance with claim 1, wherein said rotary cutter is movable downwardly under its own weight and is movable upwardly by soil being delivered to said rotary cutter.

3. Apparatus in accordance with claim 2, wherein said rotary cutter is arranged near a discharge side of the conveyer.

4. Apparatus in accordance with claim 1, wherein each of said at least one rotary striker has detachable blades, and each of said detachable blades is constituted by hard plates and soft plates which are alternately arranged.

5. Apparatus in accordance with claim 3, wherein each of said detachable blades has a hard plate at each end thereof.

6. Apparatus comprising:

a vehicle body;

a soil improving and mixing device installed on said vehicle body, said soil improving and mixing device comprising:

a hopper for receiving soil;

a hopper for receiving a soil improving agent;

a conveyer for carrying soil and soil improving agent supplied from said hoppers; and a crusher for crushing and mixing soil and soil improvement agent carried by said conveyor, said crusher having a front frame and a rear frame, said rear frame being capable of swinging with respect to said front frame;

wherein said crusher includes a rotary cutter in an upper part thereof and a plurality of rotary strikers in a lower part thereof, and wherein at least one of said plurality of rotary strikers is attached to said rear frame of said crusher.

7. Apparatus in accordance with claim 6, wherein said rotary strikers have detachable blades, and each of said detachable blades is constituted by hard plates and soft plates which are alternately arranged.

8. Apparatus in accordance with claim 7, wherein each of said detachable blades has a hard plate at each end thereof.

9. Apparatus in accordance with claim 7, wherein said hard plates extend high while said soft plates extend low such that said hard and soft plates form an uneven top surface, and wherein two of said hard plates are arranged at opposite ends of each respective blade.

10. A method of using a crusher to crush and mix soil and a soil improving agent carried by a conveyer, wherein the crusher contains a rotary cutter on a stand arranged in an inlet opening of the crusher and a plurality of rotary strikers disposed behind the rotary cutter, said method comprising the steps of:

delivering soil and soil improving agent carried by the conveyor to said rotary cutter;

using said rotary cutter to cut, crush and mix thus delivered soil and soil improving agent;

delivering cut, crushed and mixed soil and soil improving agent from said rotary cutter to said plurality of rotary strikers;

using said plurality of rotary strikers to strike, crush, and mix thus cut, crushed and mixed soil and soil improving agent into small particles; and varying a speed of said conveyor at a speed depending upon characteristics of said soil.

11. A method in accordance with claim 10, further comprising the step of mounting said rotary cutter so that said rotary cutter is movable downwardly under its own weight and is movable upwardly by soil being delivered to said rotary cutter.

* * * * *